United States Patent [19]

Schmidt et al.

[11] 4,436,293

[45] Mar. 13, 1984

[54] ROTARY SUPPORT FOR CONTINUOUS CASTING LADLES

[75] Inventors: Paul Schmidt, Cologne, Fed. Rep. of Germany; Edouard Legille, Luxembourg, Luxembourg

[73] Assignee: Paul Wurth S.A., Luxembourg

[21] Appl. No.: 439,354

[22] Filed: Nov. 4, 1982

[30] Foreign Application Priority Data

Nov. 13, 1981 [LU] Luxembourg ..... 83753

[51] Int. Cl.[3] ..... C21B 3/00

[52] U.S. Cl. ..... 266/276; 266/99; 266/165; 164/335

[58] Field of Search ..... 266/276, 99, 236, 165, 266/143; 164/335, 336, 337, 438, 437; 222/591, 607

[56] References Cited

U.S. PATENT DOCUMENTS 3,693,960 9/1972 Golde et al. ..... 266/276

3,717,331 2/1973 Simons ..... 266/236

4,270,738 6/1981 Dangeleit et al. ..... 266/276

*Primary Examiner*—L. Dewayne Rutledge

*Assistant Examiner*—S. Kastler

*Attorney, Agent, or Firm*—David S. Fishman

[57] ABSTRACT

This invention presents a rotary support for continuous casting ladles, which comprises a vertical column, a drive mechanism for pivoting this column about its vertical axis, a cross arm structure carried by this column and having at least one of its ends in the form of a horizontal fork, each of the two branches of which comprises means for carrying between them a casting ladle, means for raising and lowering the ladle independently of the cross arm, means for weighing the ladle, and means for stabilizing the ladle without influencing the measurement of the weight, the means for carrying the ladle and the means for raising and lowering it being composed, in each of the branches of the fork, of a ladle carrier carriage sliding vertically between a pair of rails under the action of at least one hydraulic jack.

16 Claims, 4 Drawing Figures

ROTARY SUPPORT FOR CONTINUOUS CASTING LADLES

FIELD OF THE INVENTION

This invention relates to the field of continuous casting ladles. More particularly, this invention relates to rotary support structures for continuous casting ladles.

Continuous casting is characterized by the continuous formation of billets by flowing molten metal from a casting ladle. In order to achieve continuity of casting, particularly in the replacement of an empty ladle by a full ladle, an intermediate vessel is generally provided to form a buffer, the capacity of this intermediate vessel being sufficient to prevent an interruption in the casting during the changing of the main ladle. Nevertheless, it is necessary for the changing of the ladle to be effected as quickly as possible; and this requirement is one of the primary reasons for which two ladles are generally provided. These two ladles are carried by a rotary support structure; and rotation of this support structure through 180° brings the full ladle to the position immediately previously occupied by the empty ladle for pouring from the full ladle.

In addition to the rotary design of this support structure, it is also required that the ladles be capable of being raised and lowered while they are carried on their support, for constructional and/or operational reasons. Moreover, in order to monitor the actual casting continuously and to determine accurately the moment when the ladle is empty, it is necessary for the weight of the ladle to be continuously known. Because of the need to know weight, each ladle rests, as a rule, in its support arm, on a plurality of balances (i.e., weighing devices) which supply information regarding the contents of the ladle.

In order to realize the complexity of these problems, it is necessary to consider the conditions under which a continuous casting operation is carried out. The casting ladles of a high capacity installation may have a capacity of up to four hundred tons, which means that the weight of the whole arrangement comprising the support and the full casting ladle is on the order of five to six hundred tons. In view of the further fact that the operation is carried out at the extremely high temperatures of molten metal, the possibility of substantial thermal deformation also must be taken into account.

Up to the present time all these problems have been solved only by utilizing apparatus and systems which are complicated and expensive and in which, notwithstanding these complications and expense, the results of the weighing are greatly affected by thermal deformations and also by forces and shocks which may occur.

SUMMARY OF THE INVENTION

The above discussed and other problems of the prior art are overcome or reduced by the apparatus of the present invention. In accordance with the present invention, a new rotary support for continuous casting ladles is achieved which is simpler, less expensive, and at the same time more efficient and reliable than known devices.

Generally stated, the present invention includes a rotary support for continuous casting ladles, which comprises a vertical column, a drive mechanism for pivoting this column about its vertical axis, a cross arm structure carried by this column and having at least one of its ends in the form of a horizontal fork, each of the two branches of which comprises means for carrying between them a casting ladle, means for raising and lowering the ladle independently of the cross arm, means for weighing the ladle, and means for stabilizing the ladle without influencing the measurement of the weight, the means for carrying the ladle and the means for raising and lowering it being composed, in each of the branches of the fork, of a ladle carrier carriage sliding vertically between a pair of rails under the action of at least one hydraulic jack.

An important feature of the rotary support structure for continuous casting ladles of the present invention is that the end of each branch of the horizontal suspension fork comprises a support housing or chassis in which is mounted a U-shaped weighing frame having a vertical axis and having two vertical branches which form the rails of the ladle carrier carriage. Other important features are that the weighing frame rests on a single balance or weighing mechanism fixed to the bottom of the chassis on the axis of symmetry of the frame; and that the stabilization means are composed of at least two sets of elastic blades, (i.e., leaf springs) respectively connecting the weighing frame to the chassis.

The balance or weighing mechanism is preferably composed of a strain gauge, preferably detachably fixed to the bottom of the support chassis. The support housing or chassis may simply be composed of two side walls fixed to a bottom plate and carried directly by the support arm. Preferably, a single hydraulic jack is located on the axis of symmetry of the frame and bears, on the one hand, against the frame, and on the other hand, against the ladle carriage.

Other features, characteristics and advantages of the invention will be apparent to and understood by those skilled in the art from the following detailed description and drawings.

BRIEF DESCRIPTION OF THE DRAWINGS

Referring to the drawings, wherein like elements are numbered alike in the several FIGURES.

DESCRIPTION OF THE PREFERRED EMBODIMENT

Figure 1:
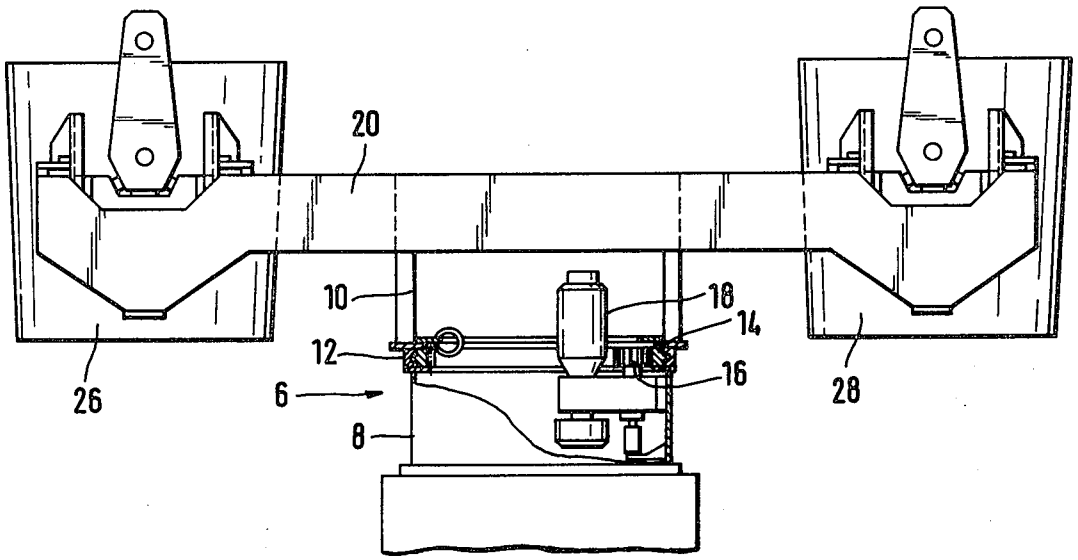
FIG. 1 is a general side elevation view of the rotary support structure of the present invention carrying a casting ladle at each end.

Referring to the general view shown in FIG. 1, a column 6 consists of a fixed base 8 on which is mounted a rotary column segment 10, with bearing 12 being disposed between the fixed base 8 and the rotary column 10 in order to permit the rotation of the column segment 10 relative to the base 8. The part of the bearing 12 which is fixed to the column 10 is provided with a toothed ring 14, which is driven by a drive pinion 16, which in turn is driven by a suitable motor, such as an electric motor 18.

Figure 2:
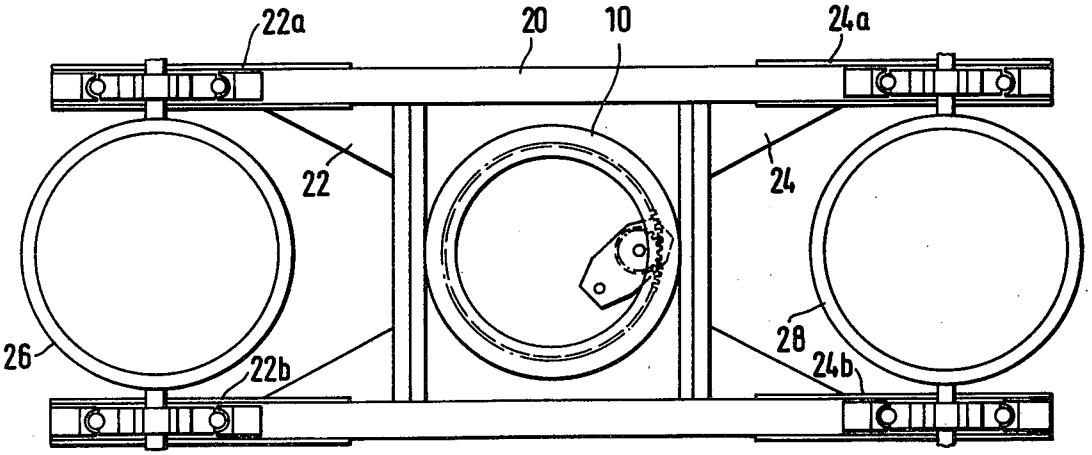
FIG. 2 is a top plan view of the rotary support structure shown in FIG. 1.

Rotary column 10 has fixed thereto and carries a supporting cross arm structure 20, the two opposite ends of which terminate in bifurcated end arms or forks 22 and 24. The branches or segments **24*a* and 24*b* of the fork 24, and the branches or segments 22***a* and 22*b* of the fork 22, are configured and constructed so that each will support a casting ladle, indicated respectively by the references 26 and 28 in FIGS. 1 and 2. If it is assumed that casting is being effected from the ladle 28, the ladle 26, which will be placed in casting position shortly before the ladle 28 is empty, will be brought into the casting position coupled by the ladle 28 of FIGS. 1 and 2 by a 180° rotation of the support arm 20, brought about by the motor 18 through column segment 10.

Figure 3:
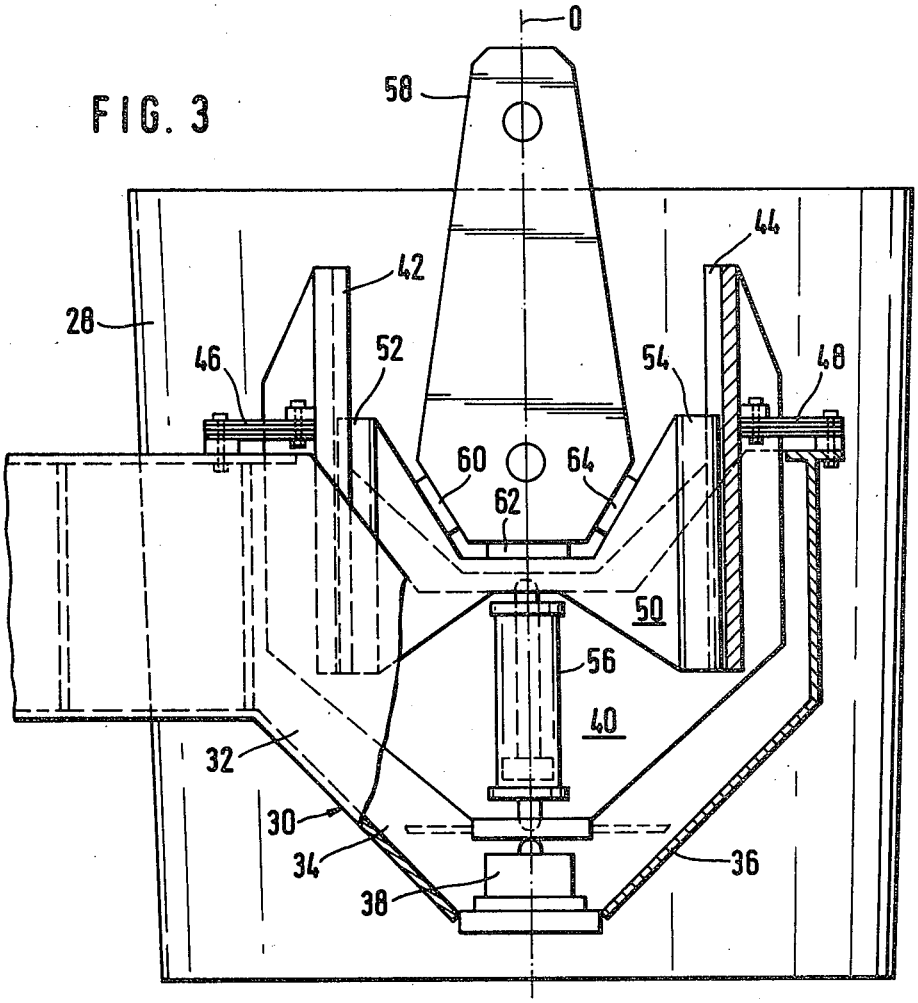
FIG. 3 shows an enlarged view, partly in section, of the details of the suspension of a ladle on one of the branches of the fork of the support arm.
Figure 4:
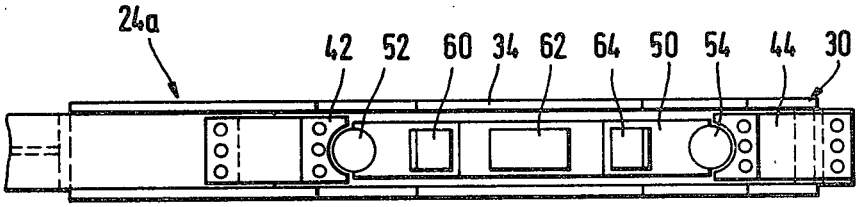
FIG. 4 is a top plan view of the detail shown in FIG. 3.

Referring now to FIGS. 3 and 4, the details of a casting ladle support will be described, with reference being made to the branch or segment 24*a* of the fork 24 of the cross arm 20. It is, however, obvious and will be understood that the structure of the branches 22*a* and 22*b* of the fork 22, and also the branch 24*b* of the fork 24, is identical to that described with respect to branch 24*a*.

As shown in FIGS. 3 and 4, the end of the branch 24*a* is in the form of a cradle-shaped chassis or housing 30, which is preferably symmetrical relative to a central vertical axis of symmetry O. This chassis or housing 30 may simply be composed of two vertical side walls 32, and 34 which are closed and joined at the bottom by a plate 36 and open at the top so as to define a hollow space.

An electronic weighing cell 38, which may be in the form of strain gauge apparatus well known in the art, is located in chassis 30. According to one feature of the present invention, it is preferred that only a single weighing cell 38 be employed, the cell being axially disposed along the axis O. The weighing cell 38 is preferably fixed detachably to the chassis 30, for example by means of screws or bolts (not shown).

Inside the chassis 30 there is located a U-shaped weighing frame 40 whose two vertical side branches are in the form of rails 42 and 44. Frame 40 is also coaxial and symmetrical relative to the axis O; and frame 40 rests freely on the strain gauge 38.

The lateral stability of frame 40 is ensured by two sets of leaf spring blades 46 and 48 connected between the rails 42, 44 and the chassis 30. These leaf springs 46 and 48 supply the lateral support of frame 40, so that frame 40 will aways remain in a vertical position. However, because of their flexibility, the leaf springs 46 and 48 do not affect the action of the frame on the strain gauge 38.

Within frame 40 there is positioned a ladle carrier carriage 50, coaxial and symmetrical in relation to the axis O. The two side edges 52 and 54 of carrier carriage 50 form slides in conjunction with the rails 42 and 44, so that carrier carriage 50 can slide vertically on the rails 42 and 44. Instead of providing slides of circular section between the carriage 50 and the rails 42 and 44, as shown in FIG. 4, it is also possible to provide roller slides. The carrier carriage 50 is carried by a hydraulic jack 56 axially disposed along the axis of symmetry O and bearing against the bottom of the frame 40. The action of this jack 56 results in the vertical sliding of the carriage 50 on the rails 42 and 44 of frame 40. Instead of providing a single jack, as shown in FIG. 3, it is also possible to provide two jacks disposed one on each side of and symmetrical with respect to the axis O.

The top surface of the carriage 50 is the actual support for the ladle 28. This top surface is preferably slightly recessed in order to ensure better support of the ladle 28; and, as shown in FIGS. 3 and 4, it may include a plurality of support blocks 60, 62 and 64 positioned to receive a handle 58 of the ladle 28.

The support of the present invention, as described above, is of extremely simple construction, a feature which is advantageous both from the points of economy of cost of its manufacture and in ease of assembly and disassembly for maintenance or repair. In addition, one of the most important features of the support structure of the present invention is the fact that it has only a single weighing cell, disposed along the axis of symmetry. This feature by itself constitutes an important economic advantage in comparison with known supports, which contain more than one weighing cell. In addition, since the single component of all the forces is situated on the axis O, it acts directly on the cell 38, while disturbing forces originating from thermal deformation, and also from shocks and internal forces, are eliminated, so that the weighing is as accurate as possible. Moreover, the cell 38 is easily accesible from below and can be rapidly removed as a whole from the chassis 30 for maintenance, repair or replacement.

It should be noted that the embodiment described above is capable of numerous modifications without departing from the scope of the invention. If necessary, it is, in particular, possible to provide more than two sets of support leaf springs for the weighing frame, for example additional springs between this frame and the walls 32 and 34 of the chassis.

In another modified embodiment, the function of raising and lowering the ladle, which is effected by the carriage with the aid of the jack, can be carried out directly by the support arm, for example with the aid of a support arm in the form of a parallelogram or of an arm sliding vertically relative to the column, through the action of a hydraulic jack. In this case, a jack would no longer be required in the chassis. The single weighing cell would, however, still remain in the chassis, situated on the central axis.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. In a rotary support for continuous casting ladles, which includes a vertical column, a drive mechanism for rotating the vertical column about its vertical axis, a cross arm carried by the vertical column and having at least one of its ends bifurcated to form a pair of support arms, each of the two arms comprising means for carrying between them a casting ladle, the improvement comprising:

a support housing carried at the end of each of said support arms;

weighing cell means attached to said housing at the bottom thereof;

a U-shaped weighing frame vertically mounted in said housing, said weighing frame having an axis of symmetry;

said weighing frame being on said weighing cell and said weighing cell being positioned along said axis of symmetry;

said U-shaped weighing frame having a pair of guide rails forming vertical guide arms;

ladle carrier carriage means adjustably mounted in said weighing frame and movable on said guide rails of said weighing frame, said carriage means being symmetrical with respect to said axis of symmetry;

means for raising and lowering said ladle carrier carriage means; and stabilization means between said weighing frame and said housing.

2. The rotary support of claim 1 wherein:

said stabilization means includes at least two sets of leaf spring elements connected to said weighing frame and to said housing..

3. The rotary support of claim 2 wherein:

said weighing cell includes strain gauge means.

4. The rotary support of claim 3 wherein:

said weighing cell is detachable mounted to the bottom of said housing.

5. The rotary support of claim 4 wherein:

said housing includes a pair of side walls connected to a bottom plate, said housing being directly connected to said support arm.

6. The rotary support of claim 5 wherein:

said means for raising and lowering said ladle carrier carriage means includes a single hydraulic jack on said axis of symmetry between said weighing frame and said ladle carrier carriage means.

7. The rotary support of claim 1 wherein:

said weighing cell includes strain gauge means.

8. The rotary support of claim 7 wherein:

said weighing cell is detachable mounted to the bottom of said housing.

9. The rotary support of claim 8 wherein:

said housing includes a pair of side walls connected to a bottom plate, said housing being directly connected to said support arm.

10. The rotary support of claim 9 wherein:

said means for raising and lowering said ladle carrier carriage means includes a single hydraulic jack on said axis of symmetry between said weighing frame and said ladle carrier carriage means.

11. The rotary support of claim 1 wherein:

said weighing cell is detachable mounted to the bottom of said housing.

12. The rotary support of claim 11 wherein:

said housing includes a pair of side walls connected to a bottom plate, said housing being directly connected to said support arm.

13. The rotary support of claim 12 wherein:

said means for raising and lowering said ladle carrier carriage means includes a single hydraulic jack on said axis of symmetry between said weighing frame and said ladle carrier carriage means.

14. The rotary support of claim 1 wherein:

said housing includes a pair of side walls connected to a bottom plate, said housing being directly connected to said support arm.

15. The rotary support of claim 14 wherein:

said means for raising and lowering said ladle carrier carriage means includes a single hydraulic jack on said axis of symmetry between said weighing frame and said ladle carrier carriage means.

16. The rotary support of claim 1 wherein:

said means for raising and lowering said ladle carrier carriage means includes a single hydraulic jack on said axis of symmetry between said weighing frame and said ladle carrier carriage means.

* * * * *

UNITED STATES PATENT AND TRADEMARK OFFICE

CERTIFICATE OF CORRECTION

PATENT NO. : 4,436,293

DATED : March 13, 1984

INVENTOR(S) : Paul Schmidt et al

It is certified that error appears in the above-identified patent and that said Letters Patent are hereby corrected as shown below:

Column 3, line 8, "coupled" should be --occupied--.

Signed and Sealed this

*Sixteenth* Day of *July 1985*

[SEAL]

*Attest:*

DONALD J. QUIGG

*Attesting Officer* *Acting Commissioner of Patents and Trademarks*